US008146776B2

(12) United States Patent
Balkin et al.

(10) Patent No.: US 8,146,776 B2
(45) Date of Patent: Apr. 3, 2012

(54) HAND PROTECTION BARRIER DISPENSER

(76) Inventors: Kenneth R. Balkin, Madison, WI (US); Catherine C. Tollefson, Madison, WI (US); Judith L. Balkin, Madison, WI (US)

( * ) Notice: Subject to any disclaimer, the term of this patent is extended or adjusted under 35 U.S.C. 154(b) by 471 days.

(21) Appl. No.: 12/365,068

(22) Filed: Feb. 3, 2009

(65) Prior Publication Data

US 2009/0200329 A1 Aug. 13, 2009

Related U.S. Application Data

(60) Provisional application No. 61/027,008, filed on Feb. 7, 2008.

(51) Int. Cl.
*B65H 3/58* (2006.01)

(52) U.S. Cl. ..... 221/26; 221/212; 221/277; 2/159; 2/161.7

(58) Field of Classification Search ..... 221/1, 45, 221/26, 212, 277; 2/159, 161.7
See application file for complete search history.

(56) References Cited

U.S. PATENT DOCUMENTS 2,592,786 A 1/1947 Birr
3,408,125 A 10/1968 Rasmussen
3,647,159 A 3/1972 Bump
4,046,508 A 9/1977 McDonald
4,131,044 A 12/1978 Cassia
4,165,138 A * 8/1979 Hedge et al. ..... 242/560
4,644,689 A 2/1987 Arians
4,658,469 A 4/1987 Hawkins
4,773,532 A * 9/1988 Stephenson ..... 206/278
4,832,942 A 5/1989 Crace
4,997,139 A 3/1991 Menard
5,314,668 A 5/1994 Biermaier
5,577,635 A 11/1996 Block
5,878,909 A * 3/1999 Rogow ..... 221/45
5,882,667 A 3/1999 Jones
5,921,434 A * 7/1999 Hollander et al. ..... 221/34
5,987,645 A 11/1999 Teaster
6,189,183 B1 2/2001 Hartselle, III
6,358,519 B1 3/2002 Waterman
6,375,034 B1 * 4/2002 Corbett ..... 221/46
6,546,594 B1 4/2003 Wills
6,645,435 B2 11/2003 Dawson et al.
6,789,695 B1 9/2004 Gaudreau
6,874,697 B2 4/2005 Callueng
6,912,728 B2 7/2005 Panella
6,925,763 B2 8/2005 Stark et al.
7,043,800 B2 5/2006 Moody
7,080,427 B1 7/2006 Campopiano et al.

(Continued)

OTHER PUBLICATIONS

Dougherty, Conor, "Restroom Decor: Germy Doorknobs Inspire Inventors" Wall Street Journal, Feb. 15, 2008.

(Continued)

*Primary Examiner* — Patrick Mackey
(74) *Attorney, Agent, or Firm* — Reinhart Boerner Van Deuren s.c.

(57) ABSTRACT

A hand protection barrier dispenser for dispensing disposable sanitary barriers for temporarily covering the hand and providing complete hand protection is disclosed which dispenses the hand protection barriers in a manner so that they may easily be donned by a user thereof. The hand protection barrier operates to open each of the hand protection barriers as it is brought into position to be dispensed. The hand protection barrier dispenser allows only a single hand protection barrier to be dispensed at a time.

20 Claims, 10 Drawing Sheets

U.S. PATENT DOCUMENTS

| | | | | |
|---|---|---|---|---|
| 7,175,807 | B1 | 2/2007 | Jones | |
| D551,476 | S | 9/2007 | Cittadino et al. | |
| 7,320,418 | B2 | 1/2008 | Sassoon | |
| 2006/0010563 | A1* | 1/2006 | Michel et al. | 2/159 |
| 2007/0170213 | A1* | 7/2007 | Gaines et al. | 223/111 |

OTHER PUBLICATIONS

Georgia-Pacific Away From Home—Safe-T-Guard Door Tissue & Dispensers, Internet listing, Feb. 15, 2008.

* cited by examiner

HAND PROTECTION BARRIER DISPENSER

CROSS-REFERENCE TO RELATED APPLICATION

This application claims priority of U.S. Provisional Patent Application No. 61/027,008, which is entitled "Hand Protection Barriers and Dispenser Therefor," and which was filed on Feb. 7, 2008, the entirety of which application is hereby incorporated herein by reference.

BACKGROUND OF THE INVENTION

Field of the Invention

The present invention pertains generally to disposable sanitary barriers for temporarily covering the hand, and more particularly to a hand protection barrier dispenser for dispensing such barriers.

People today are becoming increasingly mindful of the sanitary conditions of public facilities such as public restrooms. While most people wash their hands after using such facilities, it is common knowledge that many people do not do so. this fact has been established by a number of studies that show that as many as thirty to forty percent of people using a restroom do not wash their hands prior to leaving the restroom. In addition, such studies have also shown that those individuals that do wash their hands, only about half use soap.

Thus, harmful bacteria may often be present on the hands of public restroom users, and such harmful bacteria can be and are left behind on the restroom door handle by such users as they are exiting the restroom. Bacteria can survive sufficiently long to be passed on to subsequent restroom users even though they have washed their hands by touching the door handle as they leave the restroom. Most public restroom users would be happier with the knowledge that they can leave a restroom without picking up bacteria from previous users unwashed hands that may have been left on the restroom door handle.

For years, public restroom users have been improvising ways to exit a public restroom without touching the door handle with their bare hands. For example, such users may use a paper towel or other material to form a barrier with which to grasp the restroom door handle as they exit the restroom. However, paper towels and the like are not necessarily available in all restrooms at all times, and often there is no convenient place near the door for the restroom user to dispose of the used paper towel. Also, the porous material of a paper towel may not provide restroom users with a high degree of confidence that a protective barrier is being provided between their hand and the restroom door handle, especially if their hand and/or the door handle is even slightly wet.

As might be expected, various potential solutions to this problem have been attempted in the past. One such potential solution over this improvised method is described, for example, in U.S. Pat. No. 6,925,763, to Stark et al. The Stark et al. patent provides a tissue dispenser and separate tissue receptacle that are both mounted on or near the door handle of a restroom door. Upon exiting the restroom, a restroom user may easily grasp a tissue from the tissue dispenser, use it to open the restroom door, and dispose of the tissue in the tissue receptacle. Of course, the sheets of tissue used in the Stark et al. patent do not provide a complete hand protection barrier.

At best, such a tissue sheet only provides a barrier for the front surface of the restroom user's hand. To provide even this protection, the restroom user must take a sheet of tissue from the dispenser and manipulate it to a position that covers the restroom user's hand so that no part of the restroom user's hand touches the restroom door handle. Many restroom users using the sheet of tissue do not take the time or care to properly position the tissue to provide an effective protective barrier.

A more complex potential solution to this problem is described in U.S. Pat. No. 4,997,139, to Menard. The Menard patent provides a mechanical dispensing device that automatically dispenses a continuous sanitary covering for a restroom exit door handle. After each use of the door, the mechanical devise advances the sanitary covering to provide a new sanitary covering surface for the door handle. Although this solution may be effective, it is also much more mechanically complex and expensive to implement and is also at least potentially subject to mechanical failure.

Still another potential solution to this problem is described in U.S. Pat. No. 6,912,728, to Panella. The Panella patent provides a hygienic pocket of material that may be placed on a restroom user's hand, and has an adhesive used to temporarily retain the hygienic pocket of material on the restroom user's hand while the door handle of a restroom door is being grasped. The hygienic pockets of material are dispensed from a dispenser that is only minimally disclosed. The hygienic pocket of material consists of two sheets retained together to define the pocket, with the sheet having the adhesive thereupon being longer than the other sheet. Dispensing such hygienic pockets of material that each include adhesive does not appear to be addressed by the Panella patent.

What is desired, therefore, is a simple, inexpensive, and yet effective hand protection barrier dispenser for use by public restroom users and the like to dispense hand protection barriers. The hand protection barriers dispensed by the hand protection barrier dispenser must provide a one hundred percent complete hand protection barrier for substantially the entire hand. The hand protection barrier dispenser for dispensing such hand protection barriers must also be easy and intuitive to use, and reliably implemented.

The hand protection barrier dispenser of the present invention must also be of construction which is both durable and long lasting, and it should also require little or no maintenance to be provided by the user throughout its operating lifetime. In order to enhance the market appeal of the hand protection barrier dispenser of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The present invention takes the form of a hand protection barrier dispenser for dispensing hand protection barriers which may be located at any convenient location. The hand protection barrier dispensed by the hand protection barrier dispenser of the present invention is made of a thin, impermeable material such as plastic that defines a hand protection barrier. The hand protection barriers may be defined by two rectangular sheets that are sealed on three sides and are open on a fourth side, and they may be dispensed from a roll of such hand protection barriers that are perforated to allow a single hand protection barrier to be dispensed at a time. The open fourth side of each of the hand protection barriers may be located adjacent the perforations between each adjacent pair of the hand protection barriers.

Such hand protection barriers provide a user-friendly way for restroom users to exit a public restroom without directly contacting a potentially germ covered restroom door handle.

The hand protection barrier dispenser that is used to dispense these hand protection barriers from the roll of hand protection barriers may be mounted on a door, such as a public restroom door, adjacent to the door handle or knob, or on an adjacent wall. The hand protection barrier dispenser could of course also be mounted in other convenient locations where the dispensing of hand protection barriers is desirable. Examples of such other locations include locations in grocery store produce, meat, and bakery departments, as well as at self-service gas stations.

The hand protection barriers are dispensed from a roll of hand protection barriers located in the hand protection barrier dispenser, which has a housing cover hingedly mounted on a housing back that may be mounted on a door, a wall, or some other support. The roll of hand protection barriers are dispensed individually, with a single one of the hand protection barrier being exposed through the housing cover at a time for donning by a user. The exposed hand protection barrier is supported in a position allowing a used to easily access it by slipping the user's hand into it and pulling it from the hand protection barrier dispenser, which action also pulls the next hand protection barrier into position to be dispensed.

The hand protection barrier dispenser preferably operates in a manner allowing only a single hand protection barrier to be removed at a time. A series of rollers adjacent to the roll of hand protection barriers may be used both to place tension on the stream of hand protection barriers as they are pulled off of the roll of hand protection barriers, as well as to allow only a single hand protection barrier to be dispensed at a time. Thus, as a hand protection barrier is pulled from the hand protection barrier dispenser, it will be torn off at the perforations, leaving the next hand protection barrier presented in the position for easy donning.

In another aspect, the hand protection barrier dispenser is arranged and configured to open each of the hand protection barriers as it is brought into position to be dispensed. This may be accomplished wising either or both of two different mechanisms. One such mechanism uses a ruffling roller mounted above a hand protection barrier as it is pulled into position for dispensing. The ruffle roller 104 is supported at an angle causing the bottom edge of the hand protection barrier to be pushed somewhat to assist in opening it. Another mechanism uses a segment of magnetically attractable material on each hand protection barrier near its opening. Magnets mounted in the housing cover attract this segment of magnetically attractable upwardly, opening the hand protection barrier as it moves into position to be dispensed.

It will thus be appreciated that the hand protection barrier dispenser of the present invention may be mounted on or near a restroom door such that it is in a convenient location to dispense hand protection barriers to restroom users as they are about to leave the restroom. Such a hand protective barrier dispenser may be used in other applications, such as in grocery stores in the produce, meat, and/or bakery departments, to protect users' hands from direct contact with meat, fruit, vegetables, and/or bakery products, thereby enabling purchasers to purchase uncontaminated food. The hand protection barrier dispenser of the present invention may also be used at self-service gas stations, to prevent gasoline, oil, or other substances from contacting the user's hands. Still another potential use of the hand protection barrier dispenser of the present invention is use in cleaning pet liter containers.

It may therefore be seen that the present invention teaches a simple, inexpensive, and yet effective hand protection barrier dispenser for use by public restroom users and the like to dispense hand protection barriers. The hand protection barriers dispensed by the hand protection barrier dispenser provide a one hundred percent complete hand protection barrier for substantially the entire hand. The hand protection barrier dispenser for dispensing such hand protection barriers is also easy and intuitive to use, and it is reliably implemented.

The hand protection barrier dispenser of the present invention is of a construction which is both durable and long lasting, and which will require little or no maintenance to be provided by the user throughout its operating lifetime. The hand protection barrier dispenser of the present invention is also of inexpensive construction to enhance its market appeal and to thereby afford it the broadest possible market. Finally, all of the aforesaid advantages and objectives of the hand protection barrier dispenser of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE EXEMPLARY EMBODIMENTS

Figure 1:
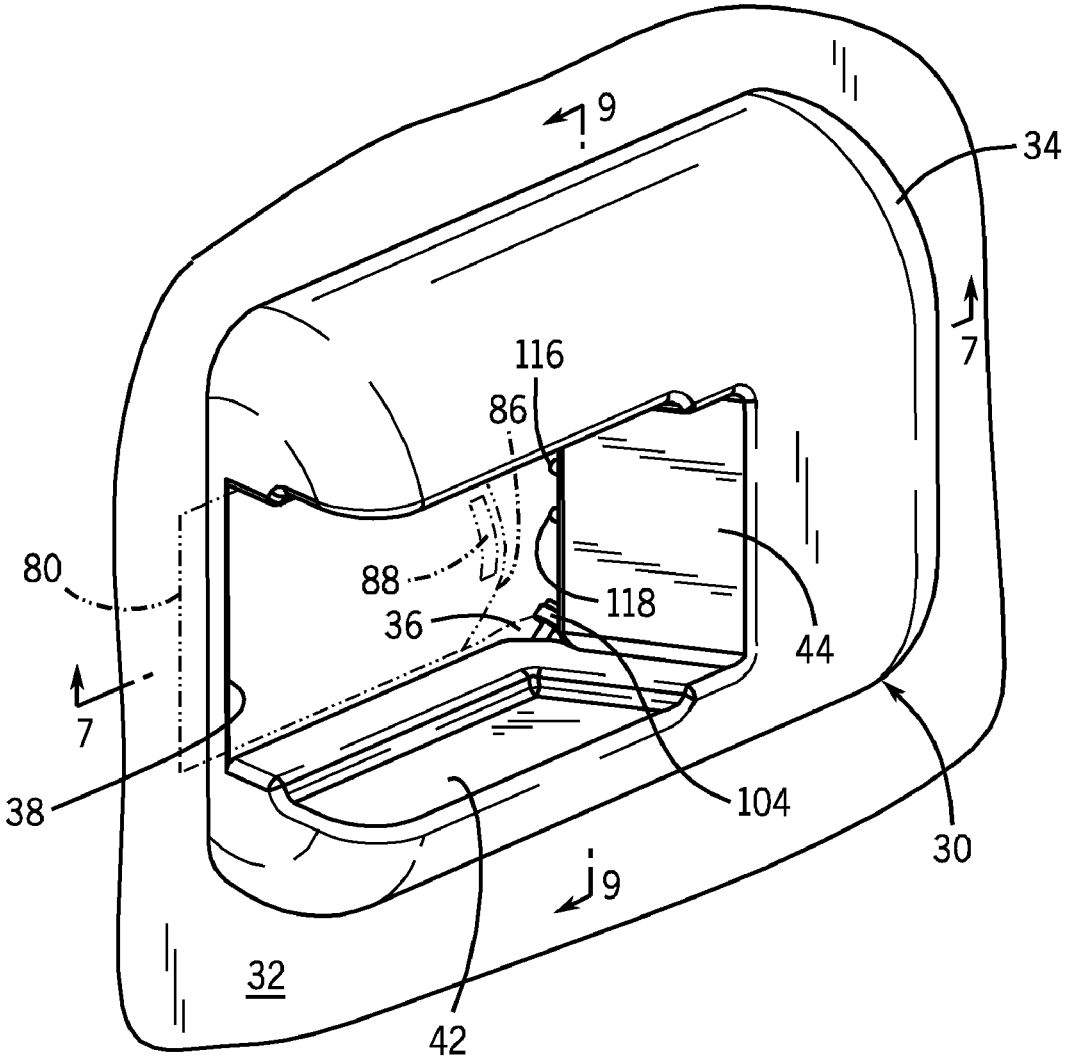
FIG. 1 is an isometric view of an exemplary hand protection barrier dispenser in accordance with the present invention mounted on a surface.

An exemplary embodiment of the hand protection barrier dispenser of the present invention is illustrated in the figures and may be discussed in conjunction therewith. Referring first to FIG. 1, a hand protection barrier dispenser 30 is shown mounted upon a surface 32. The hand protection barrier dispenser 30 includes a two-piece housing consisting of a housing cover 34 that is hingedly mounted upon a housing back 36 (that is better shown in FIG. 2). The housing cover 34 and the housing back 36 are preferably made of a lightweight and durable material, such as plastic, or any other appropriate material, that is sized, shaped, and formed, by molding or any other appropriate manufacturing process, to provide the functions described herein.

Figure 4:
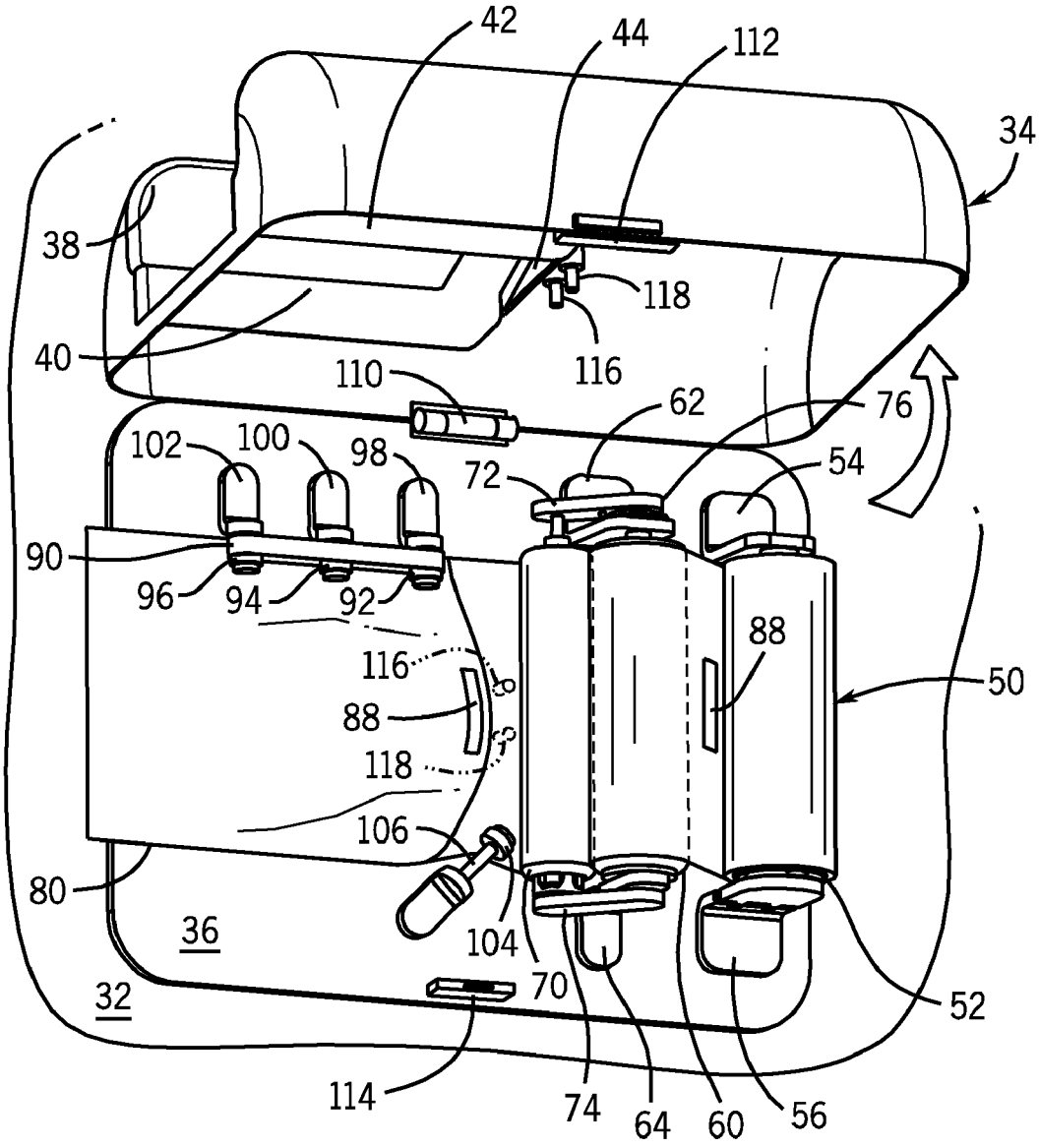
FIG. 4 is an isometric view of the hand protection barrier dispenser illustrated in FIG. 2 with the hinged housing cover mounted on the housing back in an open position.
Figure 7:
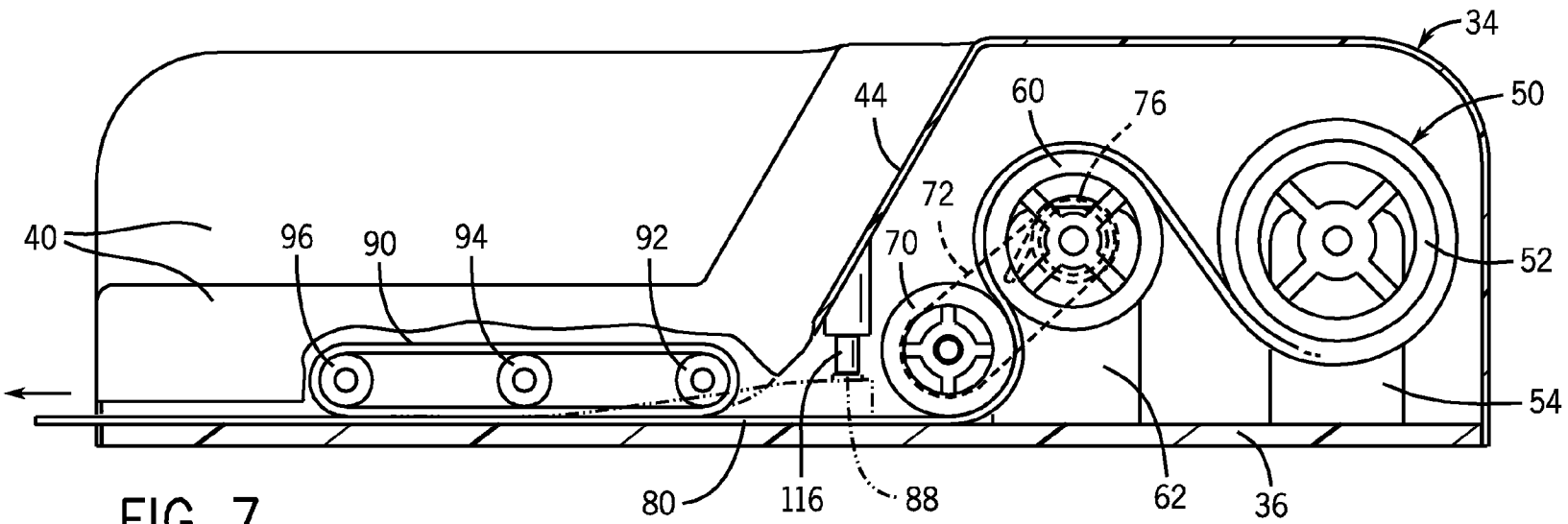
FIG. 7 is a first cross-sectional view of the hand protection barrier dispenser illustrated in FIG. 1 with the roll of hand protection barriers illustrated in FIG. 3 installed thereon.
Figure 8:
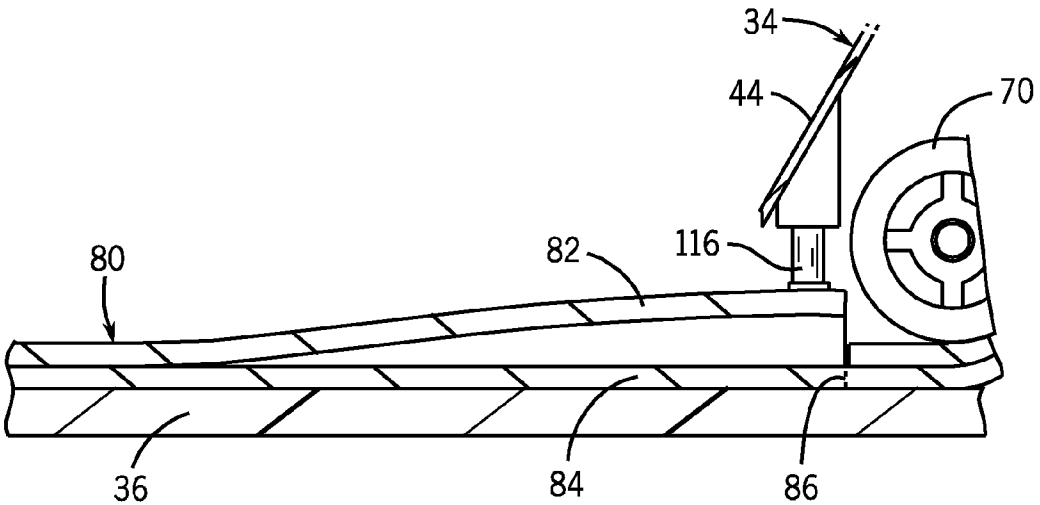
FIG. 8 is an enlarged portion of the cross-sectional view of the hand protection barrier dispenser and the roll of hand protection barriers illustrated in FIG. 7.

The housing cover 34 has a large opening 38 that is located therein such that it is accessible from roughly the left half of the housing cover 34 (as best viewed in the cross-sectional view of FIG. 7) as well as from the intermediate portion of the left side (as best shown in FIGS. 1 and 4). The opening 38 in the housing cover 34 has spaced-apart horizontal walls 40 and 42 (best viewed in FIGS. 1, 4, and 9) on the top and bottom sides, respectively, of the opening 38, and an angled wall 44 (best viewed in FIGS. 1, 7, and 9) on the right side of the opening 38. The angled wall 44 is spaced away from the housing back 36, as best shown in FIGS. 7 and 8.

Figure 2:
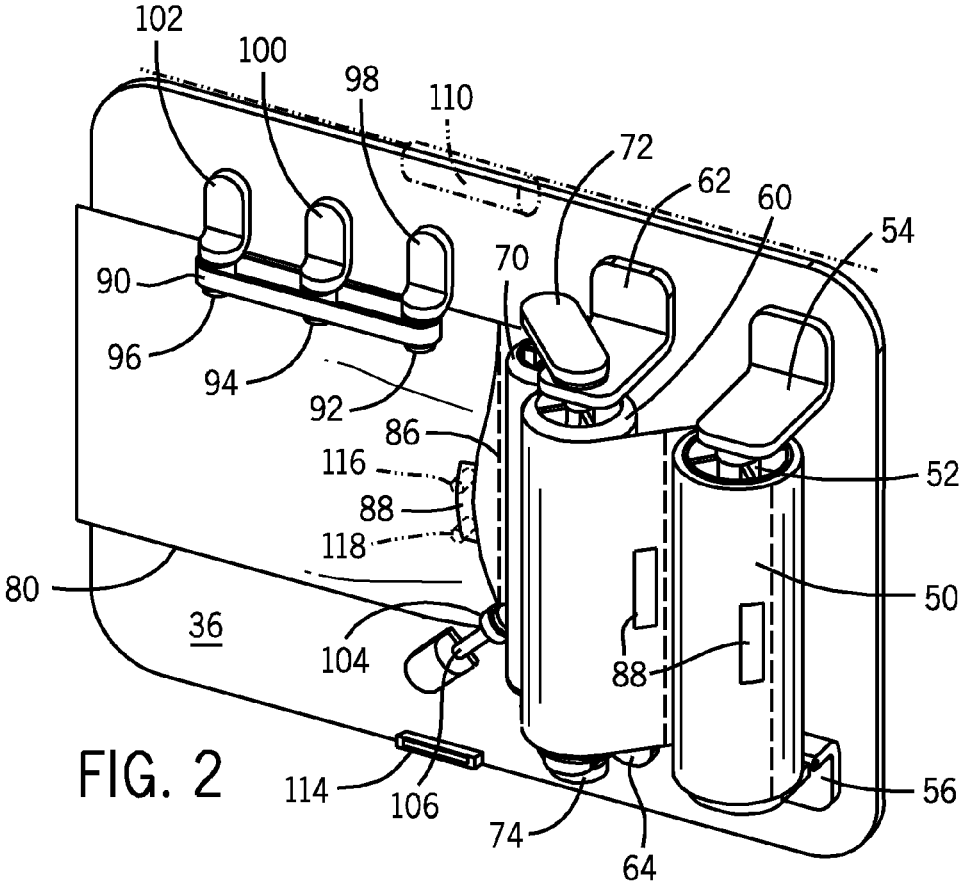
FIG. 2 is an isometric view of the hand protection barrier dispenser illustrated in FIG. 1 with a hinged housing cover removed to show the location of various components mounted on a housing back.

Referring now primarily to FIG. 2, the dispensing mechanism is shown mounted on the housing back 36. A roll of hand protection barriers 50 is mounted in a vertical orientation on a bag roller 52 that is supported near the right side of the housing back 36 by a top bag roller bracket 54 at the top end thereof and a bottom bag roller bracket 56 at the bottom end thereof, both of which are mounted onto the housing back 36. The bottom bag roller bracket 56 may be of two-piece construction to allow the installation and replacement of the roll of hand protection barriers 50 on the bag roller 52. Alternately, any other suitable construction to allow for the installation and replacement of the roll of hand protection barriers 50 may instead be used.

Located to the left of the bag roller 52 on the housing back 36 is a timing roller 60 that is also mounted in a vertical orientation. The timing roller 60 is supported by a top timing roller bracket 62 at the top end thereof and a bottom timing roller bracket 64 at the bottom end thereof, both of which are also mounted onto the housing back 36. The bottom timing roller bracket 64 may also be of two-piece construction to allow the installation and removal of the timing roller 60. Alternately, any other suitable construction to allow for the installation and removal of the timing roller 60 may instead be used. The function and operation of the timing roller 60 will be discussed below in conjunction with a description of the operation of the hand protection barrier dispenser 30.

Movably suspended to the left of the centerline of the timing roller 60 is a spring roller 70. The spring roller 70 is supported by one end of a top spring bracket support arm 72 at the top end thereof and by one end of a bottom spring bracket support arm 74 at the bottom end thereof. The other end of the top spring bracket support arm 72 is pivotably supported on the top timing roller bracket 62 about the axis of the timing roller 60, and the other end of the bottom spring bracket support arm 74 is pivotably supported under the bottom bracket 64 about the axis of the timing roller 60. A spring roller biasing spring 76 urges the top spring bracket support arm 72 in a clockwise direction as viewed from the top thereof. Optionally, another the spring roller biasing spring (not shown herein) may be used to urge the bottom spring bracket support arm 74 in a counterclockwise direction as viewed from the bottom thereof. The function and operation of the spring roller 70 will be discussed below in conjunction with a description of the operation of the hand protection barrier dispenser 30.

Figure 3:
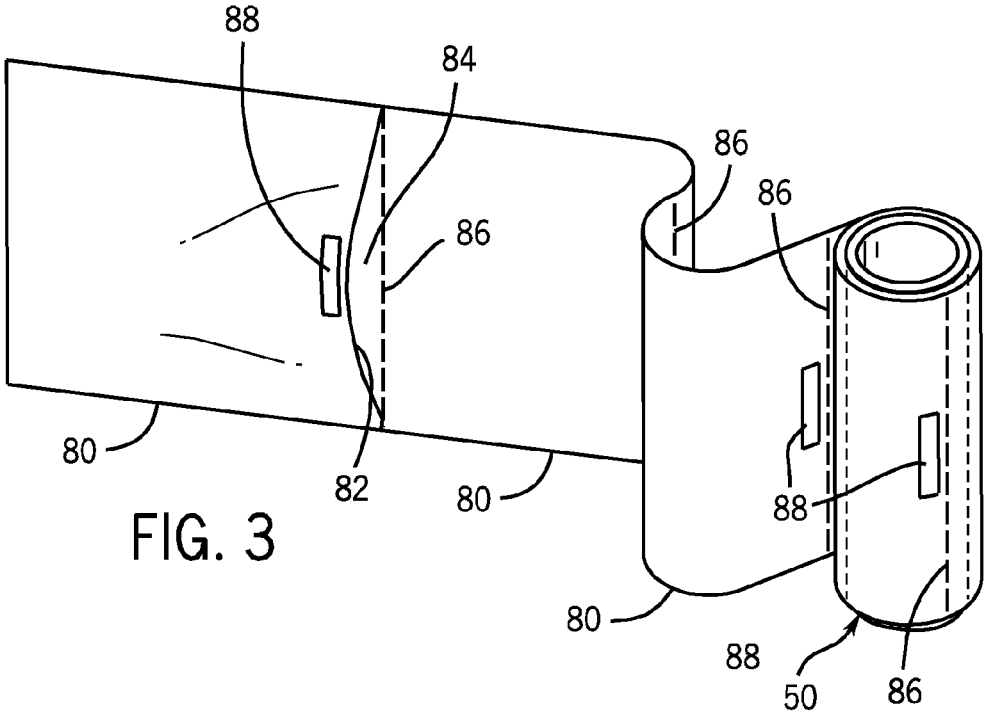
FIG. 3 is an isometric view showing a roll of hand protection barriers that may be dispensed from the hand protection barrier dispenser illustrated in FIGS. 1 and 2.

Prior to discussing the remainder of the components mounted on the housing back 36, a description of the roll of hand protection barriers 50 in conjunction with FIG. 3 will be provided. The roll of hand protection barriers 50 has a plurality of hand protection barriers 80 located in a consecutive array. Each of the hand protection barriers 80 in the roll of hand protection barriers 50 has a front side 82 and a back side 84 that are of essentially the same size and are substantially rectangular. The top and bottom sides and the left side (as viewed in FIG. 3) of each of the hand protection barriers 80 are sealed together to form a pocket. Each of the hand protection barriers 80 is thus open at the right side (as viewed in FIG. 3) thereof, and the back side 84 of each of the hand protection barriers 80 at the right side thereof is connected with a perforated connection 86 to the left side of the next adjacent one of the hand protection barriers 80.

The hand protection barriers the hand protection barriers 80 of the present invention are preferably made of a thin, impermeable material such as plastic that defines a hand protection barrier. For example, the hand protection barriers 80 may be made of polypropylene or any other suitable plastic film.

In an optional implementation, each of the hand protection barriers 80 has a segment of magnetically attractable material 88 located on the front side 82 near the opening thereof (shown at a central position adjacent the right side of the hand protection barriers 80 in FIG. 3). This segment of magnetically attractable material 88 will be used to facilitate opening each of the hand protection barriers 80 as it is dispensed, which will become evident below in conjunction with a description of the operation of the hand protection barrier dispenser 30.

Returning now to FIG. 2, the roll of hand protection barriers 50 of FIG. 3 is shown installed on the various rollers that are mounted on the housing back 36. Specifically, the roll of hand protection barriers 50 is mounted on and rotates with the bag roller 52. The hand protection barriers 80 come off of the roll of hand protection barriers 50 to the left and from the underside of the roll of hand protection barriers 50 (the side facing the housing back 36). The hand protection barriers 80 then are fed over the timing roller 60, and under the spring roller 70, and over the surface of the housing back 36 to the left, where they exit the housing cover 34 (shown in FIG. 1) and the housing back 36.

The spring roller 70 is biased by the spring roller biasing spring 76 (shown in FIG. 4) to keep tension on the hand protection barriers 80 as they unroll from the roll of hand protection barriers 50. The position of the spring roller 70 with respect to the timing roller 60 and the housing back 36 is best shown in the cross-sectional view of FIG. 7.

As the hand protection barriers 80 come off of the spring roller 70 and extend over the surface of the housing back 36, they are retained in place along the top edge thereof by a continuous sliding track 90 that is mounted on three spaced-apart rollers 92, 94, and 96. The rollers 92, 94, and 96 are respectively mounted above the housing back 36 by three track roller brackets 98, 100, and 102. The sliding track 90 retains the top edge of the hand protection barriers 80 close adjacent the surface of the housing back 36, and allows the hand protection barriers 80 to be pulled to left (as shown in FIG. 2).

As the hand protection barriers 80 come off of the spring roller 70 and extend over the surface of the housing back 36, their lower edges move under a ruffle roller 104 that is mounted above the housing back 36 by a ruffle roller support 106. Rather than being oriented about an axis parallel to the movement of the hand protection barriers 80, the ruffle roller 104 is supported by the ruffle roller support 106 at an angle tending to cause the bottom edge of the hand protection barriers 80 to be pushed somewhat upwardly to ruffle it as the hand protection barriers 80 are pulled to the left. The movement will tend to assist in the opening of each hand protection barrier 80 on the right side thereof, and acts to break any static seal that may exist between the front side 82 of the hand protection barriers 80 and the back side 84 of the hand protection barriers 80.

Referring now to FIG. 4, it may be seen that the housing cover 34 is mounted to the housing back 36 by a hinge 110 located at the tops of the housing cover 34 and the housing back 36, thereby allowing the housing cover 34 to pivot upwardly from the housing cover 34 to allow the hand protection barrier dispenser 30 to be refilled with a roll of hand protection barriers 50 when the previous roll of hand protection barriers 50 has become depleted. The housing cover 34 is retained in place on the housing back 36 at their respective bottoms by engaging latch members 112 and 114 that are respectively located on the housing cover 34 and the housing back 36.

Located on the underside of the housing cover 34 on the bottom side of the angled wall 44 are two magnets 116 and 118. The magnets 116 and 118 extend downwardly over the central portion Of the hand protection barriers 80 as they are pulled to the left from the rollers that are mounted on the housing back 36. The magnets 116 and 118 are spaced above the housing cover 34 sufficiently close to be able to attract the segment of magnetically attractable material 88 on each of the hand protection barriers 80, but sufficiently far to cause the magnets 116 and 118 to pull the segment of magnetically attractable material 88 and the edge of each of the hand protection barriers 80 up to open them as the segment of magnetically attractable material 88 passes below the magnets 116 and 118 (as best shown in FIGS. 7 and 8).

Figure 5:
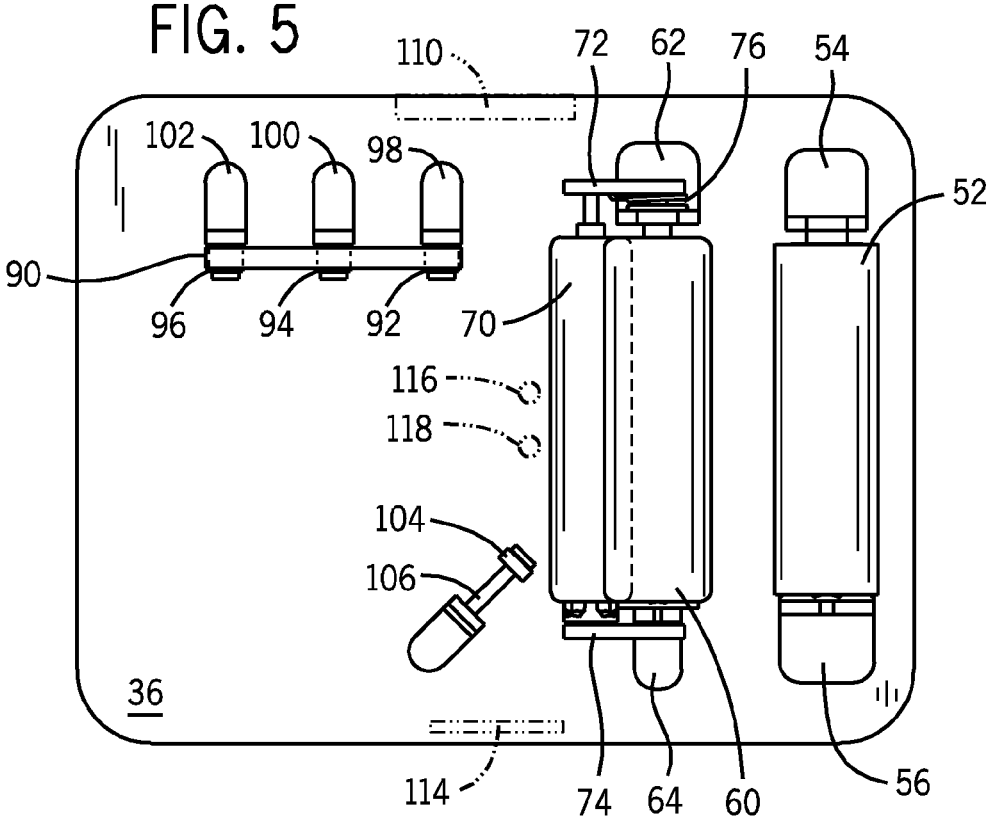
FIG. 5 is a plan view of the housing back and the various components mounted thereupon shown in FIG. 2 with the roll of hand protection barriers illustrated in FIG. 3 not installed thereon.
Figure 6:
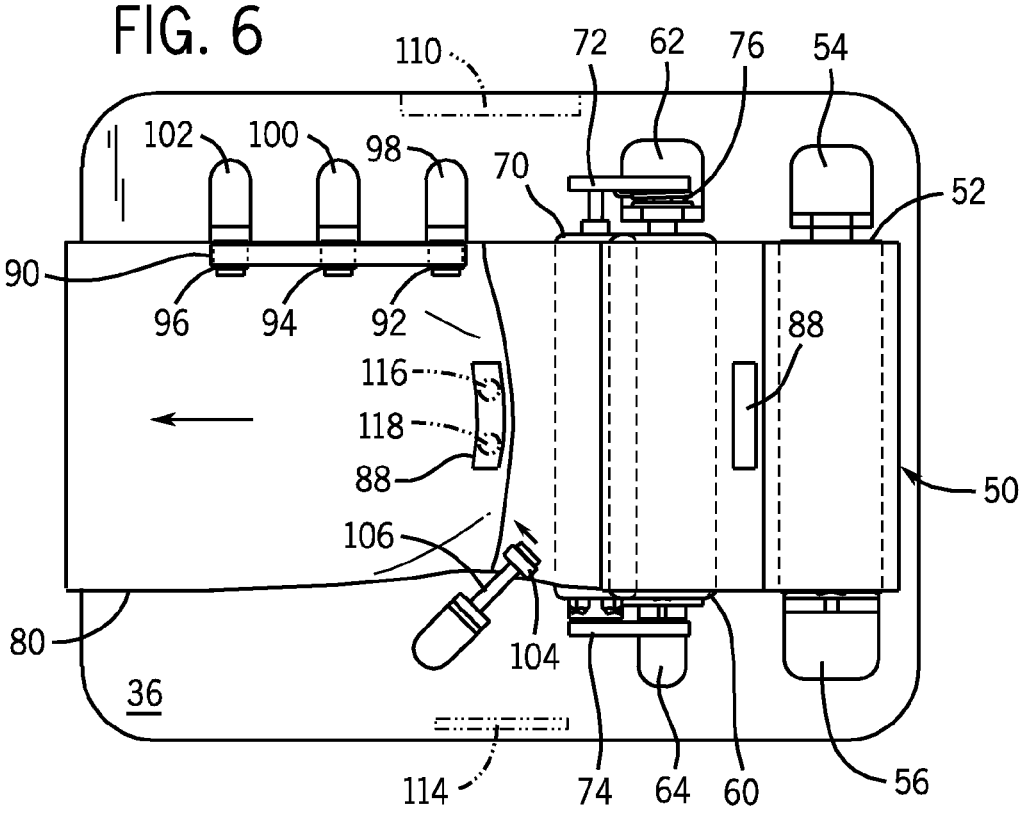
FIG. 6 is a top plan view of the housing back and the various components mounted thereupon shown in FIG. 5 with the roll of hand protection barriers illustrated in FIG. 3 installed thereon.

Referring now to FIGS. 5 and 6, the installation of the roll of hand protection barriers 50 onto the bag roller 52, the timing roller 60, and the spring roller 70 and then under the sliding track 90 and the ruffle roller 104 is shown. Note the position of the magnets 116 and 118 which are shown in phantom lines since the housing cover 34 (not shown in FIGS. 5 and 6), is not shown in a closed position on the housing back 36.

Figure 9:
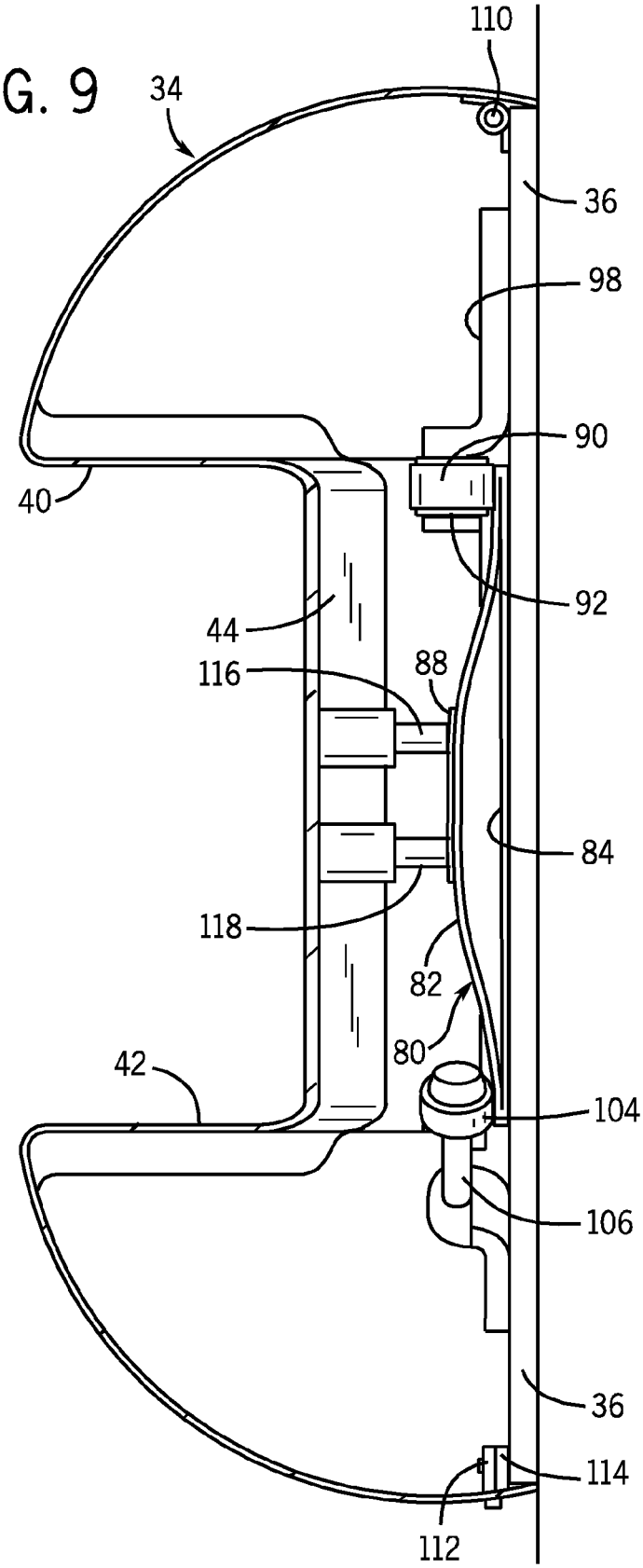
FIG. 9 is a second cross-sectional view of the hand protection barrier dispenser illustrated in FIG. 1 with the roll of hand protection barriers illustrated in FIG. 3 installed thereon.

Referring next to FIGS. 7 through 9, the use of the magnets 116 and 118 (only the magnet 116 is shown in these FIGS.) to open the hand protection barriers 80 is illustrated. As the segment of magnetically attractable material 88 on the hand protection barrier 80 passes under the magnets 116 and 118, the segment of magnetically attractable material 88 on the hand protection barrier 80 is pulled upwardly, opening the hand protection barriers 80. In addition, as best seen in FIG. 9, the ruffle roller 104 acts to move the lower edge of the hand protection barriers 80 upwardly, which also tends to assist in the opening of the hand protection barrier 80.

Figure 10:
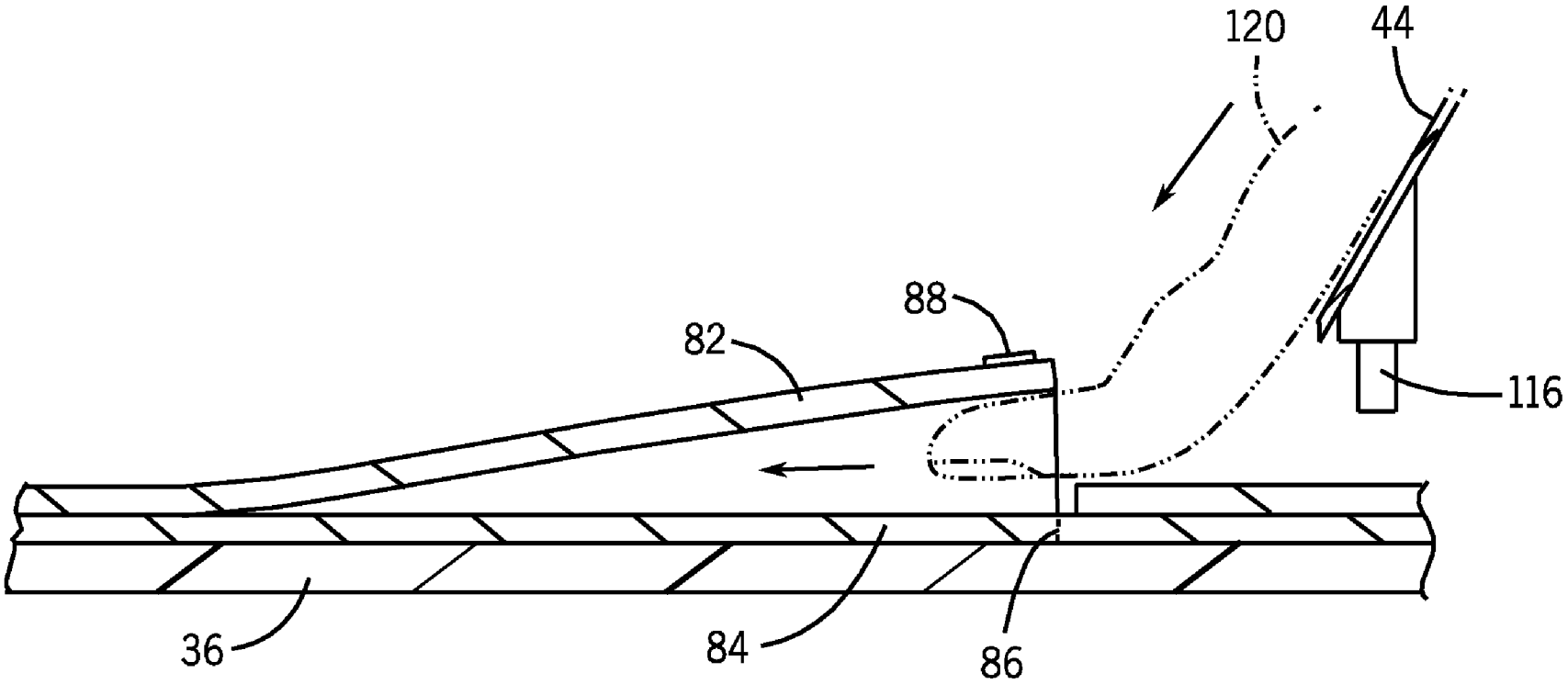
FIG. 10 is a partial cross-sectional view of the hand protection barrier dispenser illustrated in FIG. 1 with the roll of hand protection barriers illustrated in FIG. 3 installed thereon, showing a user's hand being inserted into one of the hand protection barriers.
Figure 11:
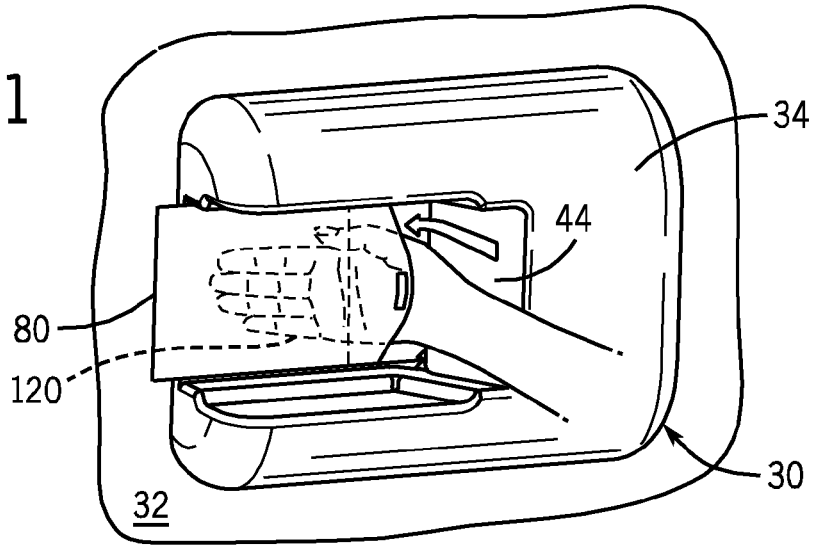
FIG. 11 is a plan view of the hand protection barrier dispenser illustrated in FIG. 1 with the roll of hand protection barriers illustrated in FIG. 3 installed thereon, showing a user's hand fully inserted into one of the hand protection barriers.

Referring next to FIG. 10, a user of the hand protection barrier dispenser 30 is shown beginning to insert the user's hand 120 into the hand protection barrier 80 that is exposed by the opening 38 in the housing cover 34 (shown in FIG. 1). The user's hand 120 is shown adjacent the angled wall 44 in the housing cover 34 as the fingers of the user's hand 120 are slipped into the exposed hand protection barrier 80 between the front side 82 of the hand protection barriers 80 and the back side 84 of the hand protection barriers 80. In FIG. 11, the user's hand 120 is shown fully inserted into the exposed hand protection barrier 80, but without the exposed hand protection barrier 80 having been moved from the position in which it is shown in FIGS. 10 and 11 (and in FIGS. 2, 4, and 6 as well).

Figure 12:
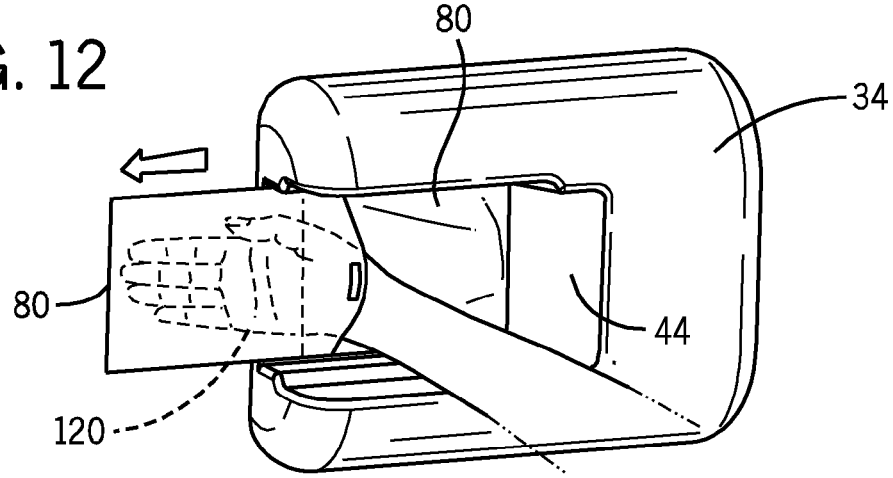
FIG. 12 is a plan view similar to the one illustrated in FIG. 11, showing the user's hand in the hand protection barrier having moved the hand protection barrier to a position from which it may be removed from the roll of hand protection barriers.

In FIG. 12, it may be seen that the user's hand 120 has pulled the exposed hand protection barrier 80 to the left, which pulls the next hand protection barrier 80 from the roll of hand protection barriers 50 (shown in FIGS. 2, 4, 6, and 7) nearly into position to be dispensed (and in this position the magnets 116 and 118 and the ruffle roller 104 shown in FIGS. 2, 4, and 6 are assisting in the opening of this next hand protection barrier 80).

Figure 13:
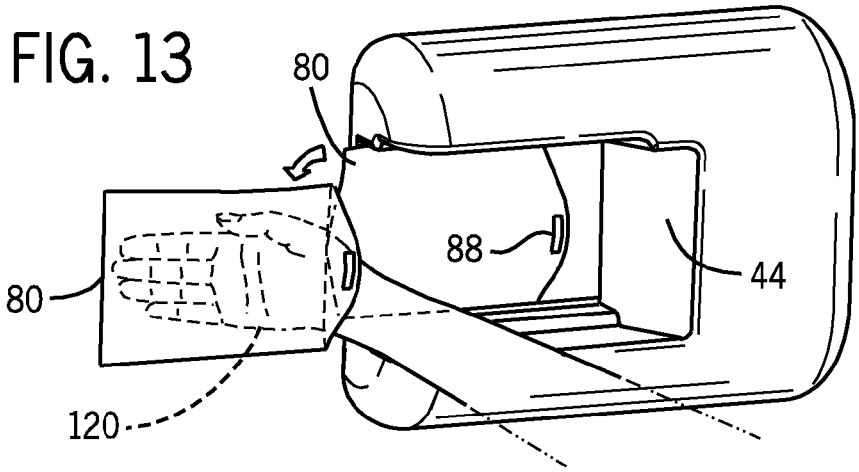
FIG. 13 is a plan view similar to the one illustrated in FIGS. 11 and 12, showing the user's hand in the hand protection barrier which has been removed from the roll of hand protection barriers.

In FIG. 13, it may be seen that the user's hand 120 has torn the exposed hand protection barrier 80 along the perforated connection 86 (shown in FIGS. 2, 3, and 8) off of the next hand protection barrier 80 from the roll of hand protection barriers 50. The user may then use the hand protection barrier 80 which is covering the user's hand 120 to open a door of a restroom, or in other manners to be discussed below.

In the preferred embodiment, only a single one of the hand protection barriers 80 is dispensed by the hand protection barrier dispenser 30 at a time. While the perforated connection 86 between adjacent hand protection barriers 80 allows a single hand protection barrier 80 to be torn off at a time, it may be appreciated that if there is no resistance to pulling out more than a single hand protection barrier 80 at a time, more than one hand protection barrier 80 may inadvertently be removed at a time. In order to prevent this from occurring, the preferred embodiment uses the timing roller 60 (shown in FIGS. 2 and 4 through 7) to allow only a single the hand protection barrier 80 to be dispensed at a time.

The timing roller 60 is arranged and configured such that it will be effective to allow only a single hand protection barrier 80 to be dispensed at a time, and may contain a mechanism therewithin or adjacent thereto to operate in this manner. It may do so by placing a tension on the stream of the hand protection barriers 80, or by momentarily stopping rotation when the timing roller 60 has been rotated an amount indicating that a single hand protection barrier 80 has been dispensed. Such mechanisms are relatively well known in the art of paper towel dispensers, and thus will not be disclosed herein in detail.

One such example of such a mechanism is found in U.S. Pat. No. 3,647,159, to Bump, which discloses a towel dispenser having automatic towel length controlling means and roll support tensioning means. Thus, the timing roller 60 is arranged and configured to rotate sufficiently far to allow the exposed hand protection barrier 80 to be pulled to the left to the point at which the next hand protection barrier 80 from the roll of hand protection barriers 50 is in position to be dispensed. At this point, the timing roller 60 will momentarily stop rotating, causing the perforated connection 86 between the exposed hand protection barrier 80 and the next hand protection barrier 80 to tear, allowing the removal of the exposed hand protection barrier 80 from the next hand protection barrier 80. U.S. Pat. No. 3,647,159, to Bump, is hereby incorporated herein by reference.

Figure 14:
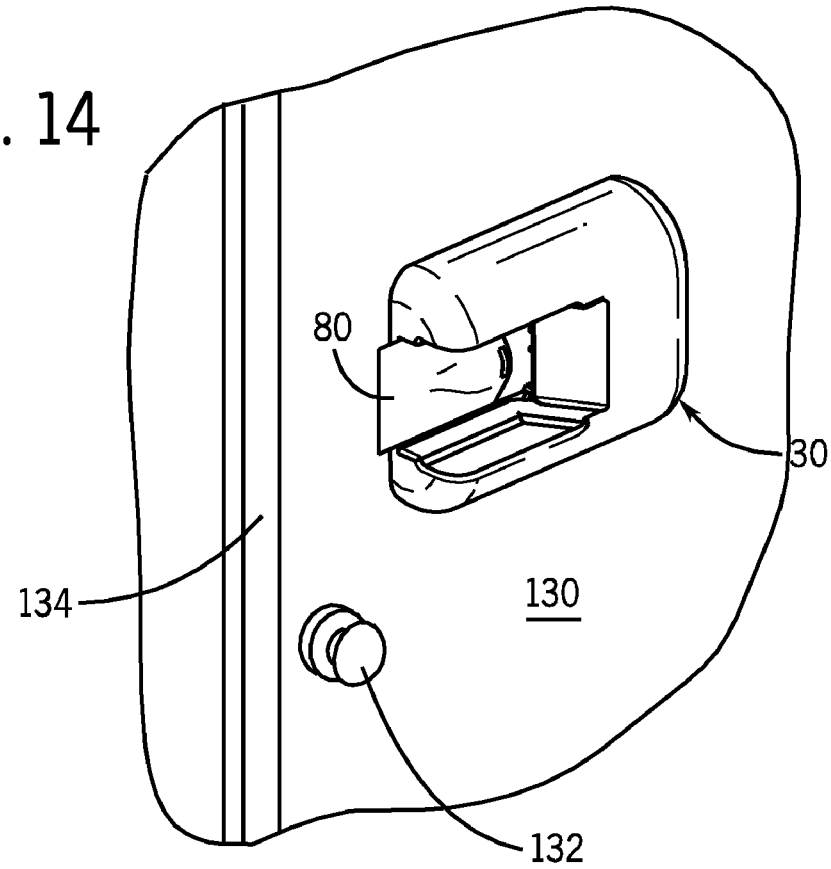
FIG. 14 is an isometric view showing the hand protection barrier dispenser and the roll of hand protection barriers shown in FIGS. 1 through 13 mounted on a restroom door near a restroom door handle.

Referring next to FIG. 14, the hand protection barrier dispenser 30 is illustrated as mounted on a restroom door 130 near the restroom door handle 132 of the restroom door 130. The restroom door 130 is mounted in a restroom door frame 134. A restroom user may dispense a hand protection barrier 80 from the hand protection barrier dispenser 30 onto the user's hand 120, and turn the restroom door handle 132 to open the restroom door 130 while using the hand protection barriers 80 to protect the user's hand 120 from bacterial potentially located on the restroom door handle 132.

Figure 15:
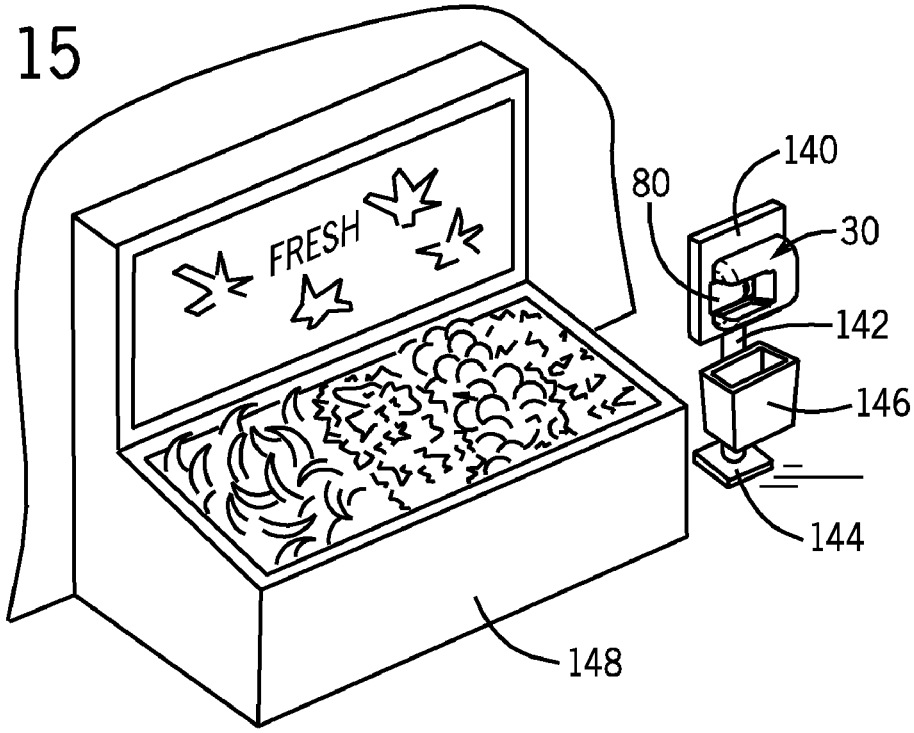
FIG. 15 is an isometric view showing the hand protection barrier dispenser and the roll of hand protection barriers shown in FIGS. 1 through 13 mounted at a location near a produce section of a grocery store.

Referring now to FIG. 15, the hand protection barrier dispenser 30 is illustrated as mounted on a dispenser support member 140 located at the top of dispenser support post 142 supported from a dispenser support base 144. Using the hand protection barrier dispenser 30, the hand protection barrier dispenser 30 may be located adjacent a produce section 148 in a grocery store. A shopper may dispense a hand protection barrier 80 from the hand protection barrier dispenser 30 onto the shopper's hand, after which the shopper may select product without potentially contaminating produce handled or selected. The hand protection barrier dispenser 30 may also find application in the bakery section or the meat department of a grocery store.

Figure 16:
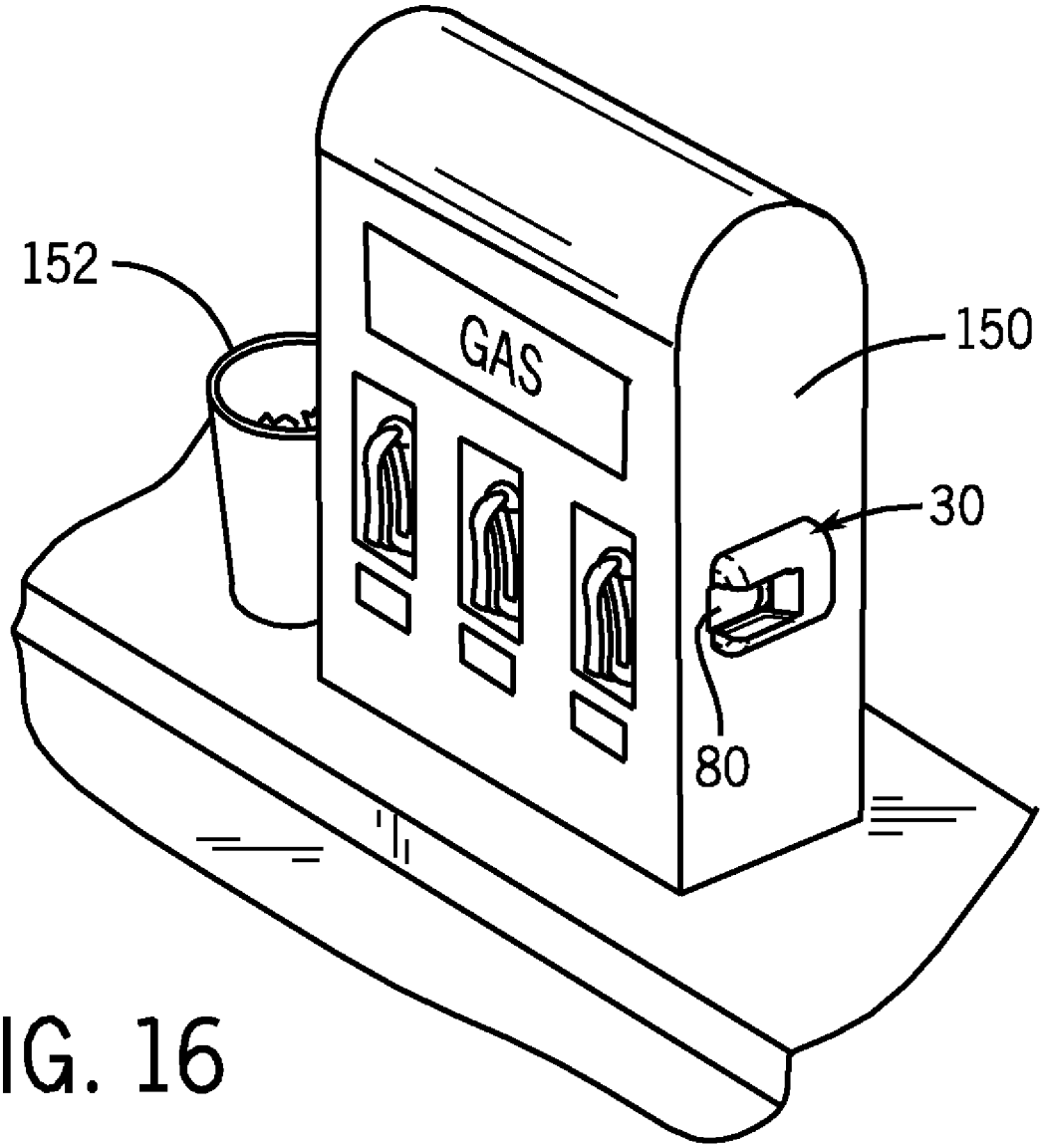
FIG. 16 is an isometric view showing the hand protection barrier dispenser and the roll of hand protection barriers shown in FIGS. 1 through 13 mounted on a gasoline pump at a service station.

Referring finally to FIG. 16, the hand protection barrier dispenser 30 is illustrated as mounted on the side of a gas pump 150. A customer may dispense a hand protection barrier 80 from the hand protection barrier dispenser 30 onto the shopper's hand, after which the shopper may pump gas from the gas pump 150. After the customer is finished, the customer may dispose of the hand protection barriers 80 into a disposal bin 152.

It may therefore be appreciated from the above detailed description of the exemplary embodiments of the present invention that it teaches a simple, inexpensive, and yet effective hand protection barrier dispenser for use by public restroom users and the like to dispense hand protection barriers. The hand protection barriers dispensed by the hand protection barrier dispenser provide a one hundred percent complete hand protection barrier for substantially the entire hand. The hand protection barrier dispenser for dispensing such hand protection barriers is also easy and intuitive to use, and it is reliably implemented.

The hand protection barrier dispenser of the present invention is of a construction which is both durable and long lasting, and which will require little or no maintenance to be provided by the user throughout its operating lifetime. The hand protection barrier dispenser of the present invention is also of inexpensive construction to enhance its market appeal and to thereby afford it the broadest possible market. Finally, all of the aforesaid advantages and objectives of the hand protection barrier dispenser of the present invention are achieved without incurring any substantial relative disadvantage.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Although the foregoing description of the hand protection barrier dispenser of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A hand protection barrier dispenser for dispensing hand protection barriers from a roll of such hand protection barriers each having an opening therein and each connected to a subsequent hand protection barrier by a perforated connection, said hand protection barrier dispenser comprising:

a housing in which the roll of hand protection barriers is mounted for dispensing, said housing having an opening through which a hand protection barrier in position to be dispensed is accessible, wherein said housing comprises a housing back upon which the roll of hand protection barriers is located;

a dispensing mechanism located in said housing intermediate the roll of hand protection barriers and said opening through which the hand protection barriers pass prior to being in position to be accessible through said opening in said housing, wherein said dispensing mechanism is located upon said housing back; and a donning assist apparatus mounted in said housing that is arranged and configured to assist in opening each of the hand protection barriers as it is moved into position to be accessible through said opening in said housing to facilitate a user inserting the user's hand through the opening in the hand protection barrier to don the hand protection barrier, wherein said donning assist apparatus is located upon said housing back and comprises:

a ruffle roller rotatably mounted on said housing back at a location at which an edge of a hand protection barrier moving into position to be accessible through said opening in said housing cover will pass between said ruffle roller and said housing back, said ruffle roller being oriented at an angle with respect to movement of the hand protection barrier moving into position to be accessible through said opening in said housing cover to cause said ruffle roller to push the edge of the hand protection barrier to ruffle it to facilitate the opening of the hand protection barrier;

wherein a hand protection barrier donned by a user may be removed from said hand protection barrier dispenser by pulling the hand protection barrier in which the user's hand is located away from a subsequent hand protection barrier to tear the perforated connection therebetween.

2. A hand protection barrier dispenser as defined in claim 1, additionally comprising:

a track apparatus mounted in the housing back for supporting an edge of the hand protection barriers adjacent to said housing back as the hand protection barriers move through the opening in said housing cover.

3. A hand protection barrier dispenser as defined in claim 2, wherein said track apparatus comprises:

a plurality of rollers that are rotatably mounted on said housing back at spaced-apart locations at which an edge of a hand protection barrier moving through said opening in said housing cover will pass between said plurality of rollers and said housing back; and a track that is moveably supported on said plurality of rollers.

4. A hand protection barrier dispenser as defined in claim 1, wherein the opening in each hand protection barrier is located adjacent the perforated connection between that hand protection barrier and the subsequent hand protection barrier, wherein said hand protection barrier dispenser is arranged and configured such that the hand protection barriers enter the opening in said housing with the opening in the hand protection barriers being the last part thereof to enter the opening in said housing.

5. A hand protection barrier dispenser as defined in claim 1, wherein said dispensing mechanism comprises:

a timing roller about which said hand protection barriers pass as they move from the roll of hand protection barriers to be accessible though said opening in said housing.

6. A hand protection barrier dispenser as defined in claim 5, wherein said timing roller is arranged and configured such that it will be effective to allow only a single hand protection barrier to be dispensed at a time through said opening in said housing.

7. A hand protection barrier dispenser as defined in claim 6, wherein said timing roller places a tension on the stream of the hand protection barriers.

8. A hand protection barrier dispenser as defined in claim 6, wherein said timing roller momentarily stops rotation when it has been rotated an amount indicative of a single hand protection barrier having been dispensed.

9. A hand protection barrier dispenser as defined in claim 1, wherein said opening is sufficiently large to allow an entire one of the hand protection barriers to be visible therethrough when the hand protection barrier is in position to be dispensed.

10. A hand protection barrier dispenser for dispensing hand protection barriers from a roll of such hand protection barriers each having an opening therein and each connected to a subsequent hand protection barrier by a perforated connection, said hand protection barrier dispenser comprising:

a housing in which the roll of hand protection barriers is mounted for dispensing, said housing having an opening through which a hand protection barrier in position to be dispensed is accessible, wherein said housing comprises a housing back upon which the roll of hand protection barriers is located;

a dispensing mechanism located in said housing intermediate the roll of hand protection barriers and said opening through which the hand protection barriers pass prior to being in position to be accessible through said opening in said housing, wherein said dispensing mechanism is located upon said housing back; and a donning assist apparatus mounted in said housing that is arranged and configured to assist in opening each of the hand protection barriers as it is moved into position to be accessible through said opening in said housing to facilitate a user inserting the user's hand through the opening in the hand protection barrier to don the hand protection barrier, wherein said donning assist apparatus is located upon said housing back and in said housing cover and comprises:

at least one magnet located in said housing cover and located above the path of hand protection barriers moving into position to be accessible through said opening, wherein said hand protection barriers each have a segment of magnetically attractable material located on a front side thereof near the opening therein that will pass beneath said at least one magnet as the hand protection barriers move into position to be accessible through said opening, said at least one magnet attracting the segment of magnetically attractable material and thereby opening the openings in the hand protection barriers;

wherein a hand protection barrier donned by a user may be removed from said hand protection barrier dispenser by pulling the hand protection barrier in which the user's hand is located away from a subsequent hand protection barrier to tear the perforated connection therebetween.

11. A hand protection barrier dispenser as defined in claim 10, wherein said at least one magnet comprises:

a pair of magnets located in said housing cover adjacent an edge of said opening in said housing cover adjacent which hand protection barriers pass as they move into position to be accessible through said opening in said housing.

12. A hand protection barrier dispenser as defined in claim 10, wherein said donning assist apparatus has a second component that is located upon said housing back and comprises:

a ruffle roller rotatably mounted on said housing back at a location at which an edge of a hand protection barrier moving into position to be accessible through said opening in said housing cover will pass between said ruffle roller and said housing back, said ruffle roller being oriented at an angle with respect to movement of the hand protection barrier moving into position to be accessible through said opening in said housing cover to cause said ruffle roller to push the edge of the hand protection barrier to ruffle it to facilitate the opening of the hand protection barrier.

13. A hand protection barrier dispenser for dispensing hand protection barriers from a roll of such hand protection barriers each having an opening therein and each connected to a subsequent hand protection barrier by a perforated connection, said hand protection barrier dispenser comprising:

a housing in which the roll of hand protection barriers is mounted for dispensing, said housing having an opening through which a hand protection barrier in position to be dispensed is accessible;

a dispensing mechanism located in said housing intermediate the roll of hand protection barriers and said opening through which the hand protection barriers pass prior to being in position to be accessible through said opening in said housing, wherein said dispensing mechanism comprises a timing roller about which said hand protection barriers pass as they move from the roll of hand protection barriers to be accessible though said opening in said housing;

a donning assist apparatus mounted in said housing that is arranged and configured to assist in opening each of the hand protection barriers as it is moved into position to be accessible through said opening in said housing to facilitate a user inserting the user's hand through the opening in the hand protection barrier to don the hand protection barrier;

a spring roller located adjacent to said timing roller and intermediate said timing roller and said opening in said housing, said spring roller being biased against said timing roller with the stream of hand protection barriers located therebetween; wherein a hand protection barrier donned by a user may be removed from said hand protection barrier dispenser by pulling the hand protection barrier in which the user's hand is located away from a subsequent hand protection barrier to tear the perforated connection therebetween.

14. A hand protection barrier dispenser as defined in claim 13, additionally comprising:

a track apparatus mounted in the housing back for supporting an edge of the hand protection barriers adjacent to said housing back as the hand protection barriers move through the opening in said housing cover.

15. A hand protection barrier dispenser as defined in claim 14, wherein said track apparatus comprises:

a plurality of rollers that are rotatably mounted on said housing back at spaced-apart locations at which an edge of a hand protection barrier moving through said opening in said housing cover will pass between said plurality of rollers and said housing back; and a track that is moveably supported on said plurality of rollers.

16. A hand protection barrier dispenser as defined in claim 13, wherein the opening in each hand protection barrier is located adjacent the perforated connection between that hand protection barrier and the subsequent hand protection barrier, wherein said hand protection barrier dispenser is arranged and configured such that the hand protection barriers enter the opening in said housing with the opening in the hand protection barriers being the last part thereof to enter the opening in said housing.

17. A hand protection barrier dispenser as defined in claim 13, wherein said timing roller is arranged and configured such that it will be effective to allow only a single hand protection barrier to be dispensed at a time through said opening in said housing.

18. A hand protection barrier dispenser as defined in claim 17, wherein said timing roller places a tension on the stream of the hand protection barriers.

19. A hand protection barrier dispenser as defined in claim 17, wherein said timing roller momentarily stops rotation when it has been rotated an amount indicative of a single hand protection barrier having been dispensed.

20. A hand protection barrier dispenser for dispensing hand protection barriers from a roll of such hand protection barriers each having an opening therein and each connected to a subsequent hand protection barrier by a perforated connection, said hand protection barrier dispenser comprising:

a housing back upon which the roll of hand protection barriers is mounted for dispensing;

a housing cover mounted on said housing back, said housing cover having an opening through which a hand protection barrier in position to be dispensed is accessible, said housing cover being removable to allow the roll of hand protection barriers to be installed;

a timing roller about which said hand protection barriers pass as they move from the roll of hand protection barriers to be accessible though said opening in said housing, said timing roller is arranged and configured such that it will be effective to allow only a single hand protection barrier to be dispensed at a time through said opening in said housing;

a spring roller being biased against said timing roller with the stream of hand protection barriers located therebetween;

a dispensing mechanism located in said housing back intermediate the roll of hand protection barriers and said opening in said housing cover through which the hand protection barriers pass prior to being in position to be accessible through said opening in said housing cover;

an apparatus mounted in the housing back for supporting an edge of the hand protection barriers adjacent to said housing back as the hand protection barriers move through the opening in said housing cover; and a donning assist apparatus mounted in said housing that is arranged and configured to assist in opening each of the hand protection barriers as it is moved into position to be accessible through said opening in said housing to facilitate a user inserting the user's hand through the opening in the hand protection barrier to don the hand protection barrier;

wherein a hand protection barrier donned by a user may be removed from said hand protection barrier dispenser by pulling the hand protection barrier in which the user's hand is located away from a subsequent hand protection barrier to tear the perforated connection therebetween.

* * * * *

UNITED STATES PATENT AND TRADEMARK OFFICE

CERTIFICATE OF CORRECTION

PATENT NO. : 8,146,776 B2
APPLICATION NO. : 12/365068
DATED : April 3, 2012
INVENTOR(S) : Kenneth R. Balkin, Catherine C. Tollefson and Judith L. Balkin It is certified that error appears in the above-identified patent and that said Letters Patent is hereby corrected as shown below:

In the specification:

Column 6, line 4
"Movably suspended to the left of the centerline of the" should read --Moveably suspended to the left of the centerline of the--.

Column 7, line 49
"central portion Of the hand protection barriers 80 as they are" should read --central portion of the hand protection barriers 80 as they are--.

In the claims:

Column 11, line 44, in claim 5,
"to be accessible though said opening in said" should read --to be accessible through said opening in said--.

Column 13, line 12, in claim 13,
"protection barriers to be accessible though said opening" should read --protection barriers to be accessible through said opening--.

Column 14, line 25, in claim 20,
"to be accessible though said opening in said" should read --to be accessible through said opening in said--.

Signed and Sealed this
Twenty-sixth Day of June, 2012

David J. Kappos

David J. Kappos
*Director of the United States Patent and Trademark Office*